US006779502B1

(12) United States Patent
Glockner

(10) Patent No.: US 6,779,502 B1
(45) Date of Patent: Aug. 24, 2004

(54) CAM SYSTEM CAPABLE OF SMALL DISCRETE ANGULAR CAM POSITIONS RELATIVE TO A ROTATABLE SHAFT

(76) Inventor: Gary Glockner, 128 Willow Winds Dr., Columbia, SC (US) 29210

( * ) Notice: Subject to any disclaimer, the term of this patent is extended or adjusted under 35 U.S.C. 154(b) by 0 days.

(21) Appl. No.: 10/703,379

(22) Filed: Nov. 7, 2003

Related U.S. Application Data

(60) Provisional application No. 60/424,507, filed on Nov. 7, 2002.

(51) Int. Cl.[7] ..... F01L 1/04

(52) U.S. Cl. ..... 123/90.6; 123/90.16; 74/567

(58) Field of Search ..... 123/90.15, 90.16, 123/90.17, 90.18, 90.6; 74/567, 568 R

(56) References Cited

U.S. PATENT DOCUMENTS 3,878,822 A * 4/1975 Beal ..... 123/90.16
4,504,838 A * 3/1985 Tamai et al. ..... 346/46
5,704,257 A * 1/1998 Kottke et al. ..... 74/813 L

* cited by examiner

*Primary Examiner*—Thomas Denion
*Assistant Examiner*—Ching Chang

(57) ABSTRACT

System uses a method of securing a cam to a rotatable shaft in a discrete angular position with respect to the shaft. The device uses leaf springs along the inside diameter of the cam to lock individual sets of cam teeth to the shaft splines. Circumferential placement of the cam teeth sets of the cam permit no more than one set of cam teeth to be fully engaged with a shaft at any one time. This provides smaller and more numerous possible incremental angular positions of the cam with respect to the shaft while the remaining partially engaged sets of cam teeth provide a locking normal force to secure the cam and the fully engaged cam teeth set onto the shaft.

2 Claims, 1 Drawing Sheet

CAM SYSTEM CAPABLE OF SMALL DISCRETE ANGULAR CAM POSITIONS RELATIVE TO A ROTATABLE SHAFT

CROSS REFERENCES TO RELATED APPLICATIONS

This application claims the benefit of U.S. Provisional Application No. 60/424,507 filed on Nov. 7, 2002.

STATEMENT REGARDING FEDERALLY SPONSORED RESEARCH OR DEVELOPMENT

Not Applicable.

BACKGROUND OF THE INVENTION

1. Field of Invention

The present invention relates to a cam system for valve position monitoring. In particular, the present invention relates to an improved cam system for valve position monitoring, wherein a cam having a plurality of unevenly spaced pairs of evenly pitched adjacent cam teeth is positioned on a rotatable shaft having evenly pitched external splines, thereby locking only one set of cam teeth onto a spline. This results in a number of possible discrete angular cam positions greater than the number of splines thereby obtaining higher angular resolution and a reduced vertical height.

2. Description of Background Art

The prior art uses a sliding spline with a compression spring to secure a cam or cams to a rotatable shaft where the shaft is coupled to a valve shaft whereby each shaft cooperates with the other in rotational movement.

BRIEF SUMMARY OF INVENTION

In view of the foregoing, the present invention has been made, and an object of the present invention is to provide a cam system of a valve position monitor, which is capable of reducing the needed parts count, improves resolution accuracy of discrete valve positions and decreases the required height of a valve position monitor.

To achieve the above object, a cam system includes a shaft member whereby at least one cam member is slidably fitted onto the shaft member causing the outer diameter of the shaft member to come into intimate contact with inner diameter of a cam member so that the axis of the cam member coincides with the axis of the shaft member. The size and pitch of adjoining cam pair teeth cooperates with the size and pitch of the individual splines of the shaft member.

However, each regular pitch cam teeth pair is located in a slightly offset circumferential position along the inner diameter of the cam member relative to where a regular pitch spacing would locate each tooth with respect to all the vacant teeth positions on the inner diameter of the cam member between each cam teeth pair. This thereby provides a capability of an incremental discrete angular resolution of the cam member in relation to the shaft member that is smaller than the spline pitch and the cam teeth pitch as well as a number of discrete cam member positions on the shaft member greater than the number of splines on the shaft member. When a cam teeth pair is urged by a contiguous leaf spring into full engagement with a shaft member spline, the remaining cam teeth pairs are only partially engaged with contiguous splines thereby causing any partially engaged teeth to provide an additional normal and securing force between the inner diameter of the cam member and the outer diameter of the shaft member.

Further scope of applicability of the present invention will become apparent from the detailed description given hereafter. However, it should be understood that the detailed description and specific examples, while indicating preferred embodiments of the invention, are given by way of illustration only and are not limitative of the present invention, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinafter, embodiments of the present invention will be described with reference to the accompanying drawings.

Figure 1:
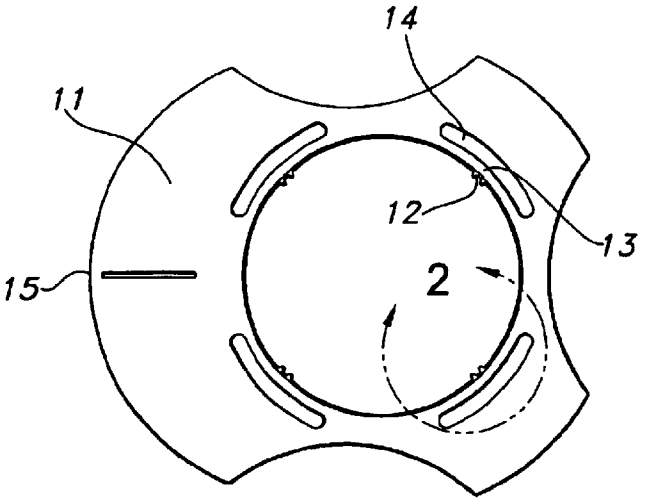
FIG. 1 shows a top view showing a cam member.

Referring first to FIG. 1, a cam member 11 is shown. The cam member 11 includes a plurality of cam teeth pairs 12 and a plurality of leaf springs 13, a leaf spring 13 disposed by and contiguous to each respective cam teeth pair 12 capable of providing a normal force urging said cam teeth pair 12 towards the axis of the cam member 11. The cam member 11 also includes a lobe 15 and a plurality of recesses 14, a recess disposed by and contiguous to each leaf spring 13, said recess 14 located and shaped so as to allow each leaf spring 13 sufficient freedom of movement towards and away from the axis of the cam member.

Figure 2:
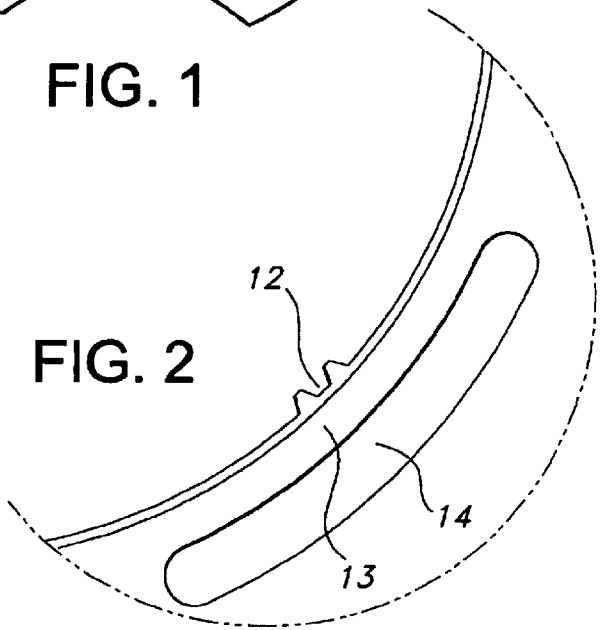
FIG. 2 is an enlarged view along line 2 of FIG. 1.

Referring to FIG. 2, an enlarged view of a part of FIG. 1, showing a cam teeth pair 12, leaf spring 13, and recess 14.

Figure 3:
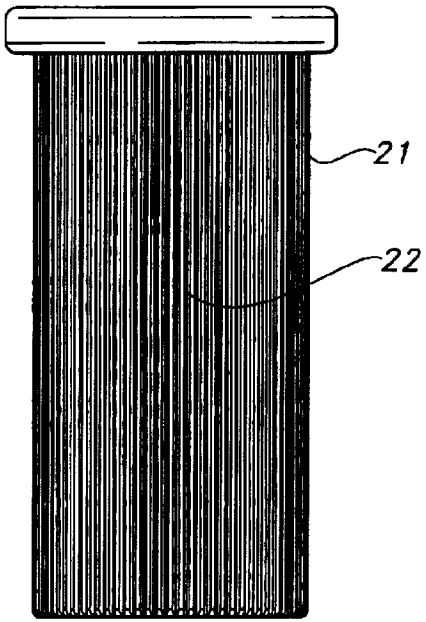
FIG. 3 shows a side view showing a shaft member.

Referring to FIG. 3, a shaft member 21 having a plurality of splines 22, located and spaced substantially evenly around the circumference of the shaft member and each spline 22 being parallel to the axis of the shaft member 21.

Figure 4:
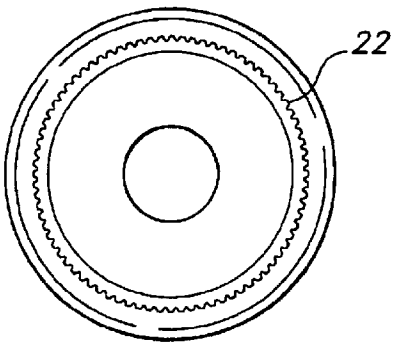
FIG. 4 shows a bottom view of FIG. 3.

Referring to FIG. 4, a bottom view of FIG. 3, shows an end view of the shaft member 21 and splines 22.

While the preferred embodiments have been described above, the present invention is not limited thereto, and it is to be understood that various changes in design may be made without departing from the scope of the claims.

The invention being thus described, it will be obvious that the same may be varied in many ways. Such variations are not to be regarded as a departure from the spirit and scope of the invention, and all such modifications are to be included within the scope of the claims.

What is claimed is:

1. A cam system, said cam system comprising:

a cam member having an axis and an inner diameter, said inner diameter having a plurality of leaf springs; and a shaft member having an outer diameter and an axis;

said cam member having its inner diameter secured to the outer diameter of said shaft member so that the axis of the cam member coincides on the axis of the shaft member;

each said leaf spring of said cam member having at least two adjacent teeth, wherein all said teeth are substantially parallel to the axis of said cam member;

said leaf springs and teeth being located circumferentially along said inner diameter of said cam member; and said shaft member having a plurality of splines on the outer diameter of said shaft member, said splines being substantially parallel to the axis of said shaft member and of the same pitch spacing as the pitch spacing of two adjacent teeth of one leaf spring, wherein one spline is aligned between and fully engaged with two adjacent teeth of one said leaf spring and no additional cam teeth are fully engaged with a spline.

2. The cam system according to claim 1, wherein the number of possible discrete cam member positions relative to said shaft member when said cam member is slidably fitted to said shaft member equals the number of possible cam teeth pitch locations multiplied by the number of leaf springs.

* * * * *